US006478443B2

(12) United States Patent
Lin

(10) Patent No.: US 6,478,443 B2
(45) Date of Patent: Nov. 12, 2002

(54) BOOKCASE LAMP

(76) Inventor: Jack Lin, P.O. Box 26-757, Taipei (TW), 106

( * ) Notice: Subject to any disclaimer, the term of this patent is extended or adjusted under 35 U.S.C. 154(b) by 0 days.

(21) Appl. No.: 09/809,755

(22) Filed: Mar. 13, 2001

(65) Prior Publication Data

US 2002/0131268 A1 Sep. 19, 2002

(51) Int. Cl.[7] ..... A47B 23/06

(52) U.S. Cl. ..... 362/132; 362/197; 362/198; 362/200; 362/253

(58) Field of Search ..... 362/132, 147, 362/419, 287, 200, 197, 198, 253

(56) References Cited

U.S. PATENT DOCUMENTS 4,432,042 A * 2/1984 Zeller ..... 362/191
4,974,130 A * 11/1990 Friedman ..... 362/200
5,709,458 A * 1/1998 Metz ..... 362/294
5,961,200 A * 10/1999 Friis ..... 362/132

FOREIGN PATENT DOCUMENTS

EP 0258373 * 6/1991 ..... 362/132

* cited by examiner

*Primary Examiner*—Thomas M. Sember
(74) *Attorney, Agent, or Firm*—Rosenberg, Klein & Lee

(57) ABSTRACT

A bookcase lamp comprises a seat, a lamp, and a switch. The seat is a casing with a flat and long shape and is assembled by a box, a lamp, and a base. The lamp is installed on the seat. The switch is installed on the seat for controlling opening and closing of the lamp. Therefore, the bookcase lamp can be placed in a bookcase like a book. As the user searches a book, the bookcase lamp will provide illumination.

5 Claims, 5 Drawing Sheets

BOOKCASE LAMP

FIELD OF THE INVENTION

The present invention relates to a bookcase lamp, and especially to a bookcase, wherein the bookcase lamp can be placed in a bookcase like a book. As the user searches for a book, the bookcase lamp will provide illumination. Furthermore, the book to be searched at one time without needing to bring the books to a bright area and without spending much time.

BACKGROUND OF THE INVENTION

From the invention of lamps, the lamps are widely used in the daily life and are an inevitable tool in the current life.

However, as shown in FIG. 1, in general, no illuminator is provided in the bookcases 1*a* of a library or a book room. As the user check data in a book 10*a* aside a bookcase 1*a*, if the illumination is weak, the user frequently brings the book to a bright area, for example, a table having an illuminator for checking data from the book 10*a*. If the data is not in the book 1*a*, the user must return back to the bookcase 1*a* for searching for another book 1*a*, and then takes the book to the bright area. As a result, this action is repeated until the required data is searched or the user deserts to search the data. Therefore, much time is spent and the whole process is inconvenient.

In general, bookcases have no effect of illumination and in some designs, table lights are place in the bookcase. However, this design is not beautiful and occupies a space. If the lamp is placed above the bookcase, since the bookcase is higher so that the opening or closing the power source is difficult. Therefore, there is an eager demand for a novel design which may improve the defects described above.

SUMMARY OF THE INVENTION

Accordingly, the primary object of the present invention is to provide a illumination device used in a compact disk receiving frame. Therefore, the bookcase lamp can be placed in a bookcase like a book. As the user searches for a book, the bookcase lamp will provide illumination. Furthermore, the book can be searched at one time without needing to bring the books to a bright area and without spending much time. Therefore, it is convenient and thus the mood of the user will not be affected.

To achieve the object, the present invention provides a bookcase lamp comprises a seat, a lamp, and a switch. The seat is a casing with a flat and long shape and is assembled by a box, a lamp, and a base. The lamp is installed on the seat. The switch is installed on the seat for controlling the actuation of the lamp.

The various objects and advantages of the present invention will be more readily understood from the following detailed description when read in conjunction with the appended drawing.

DETAILED DESCRIPTION OF THE PREFERRED EMBODIMENTS

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
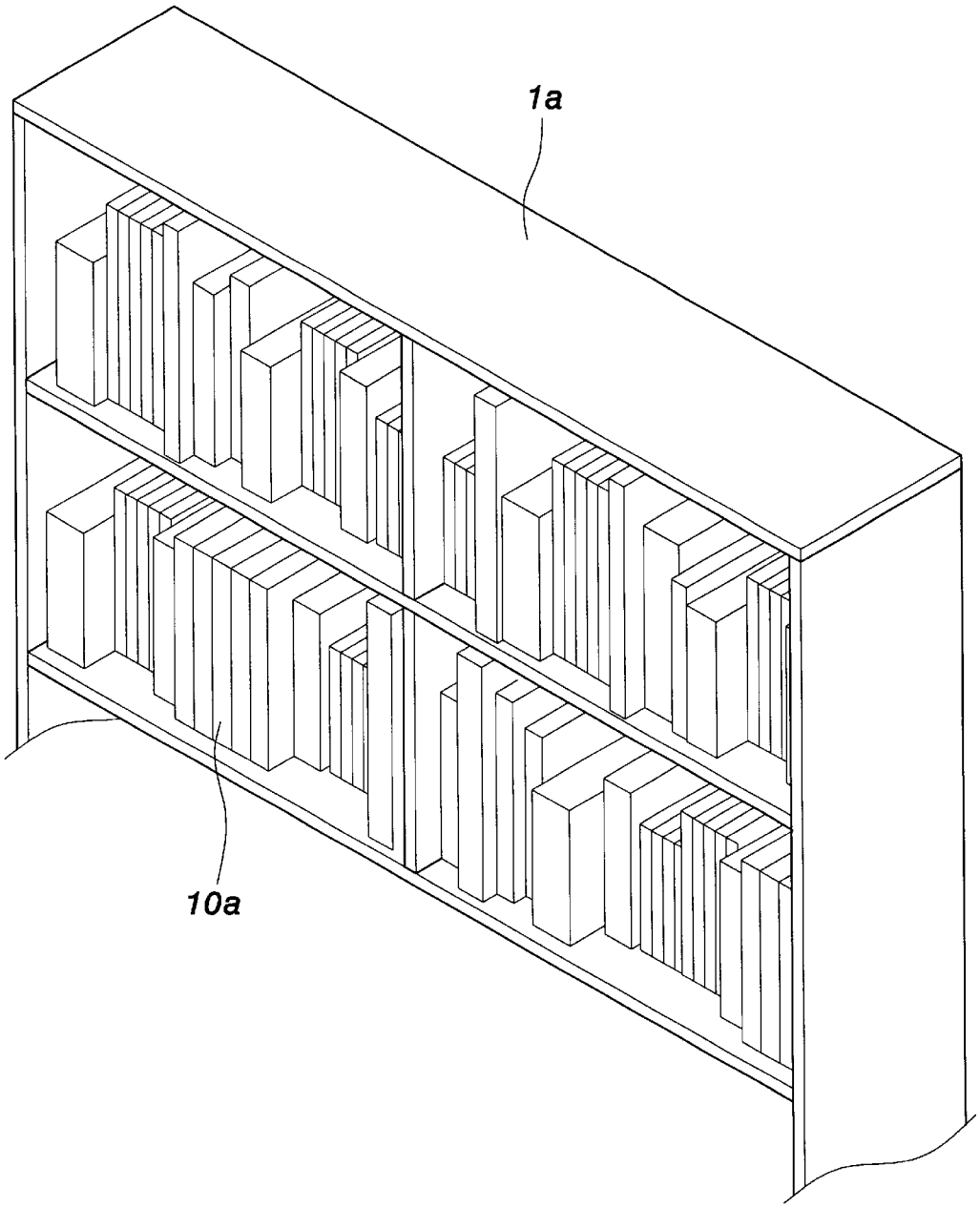
FIG. 1 PRIOR ART
FIG. 1 is a schematic view of a prior bookcase.
Figure 2:
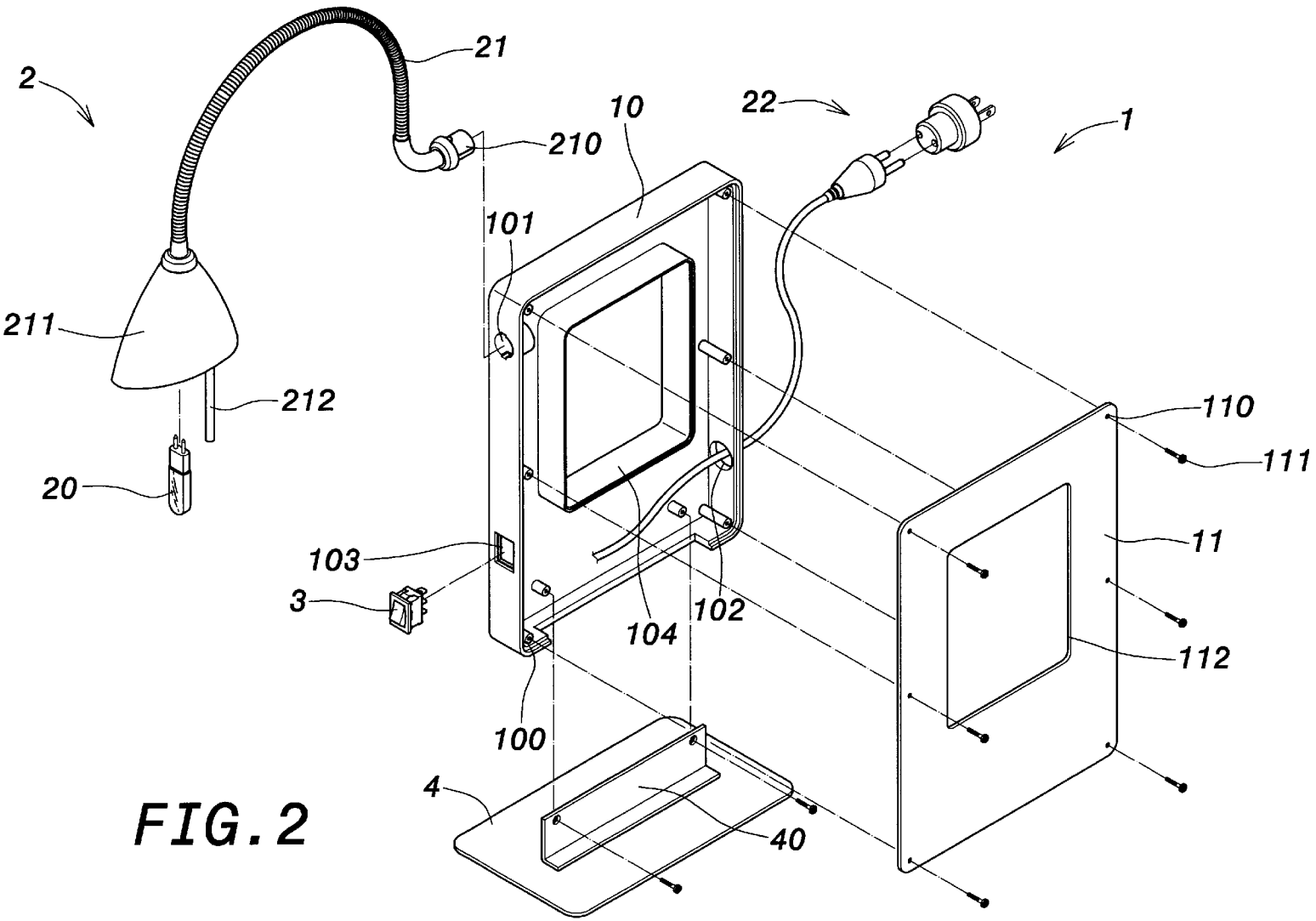
FIG. 2 is an exploded perspective view of the present invention.
Figure 3:
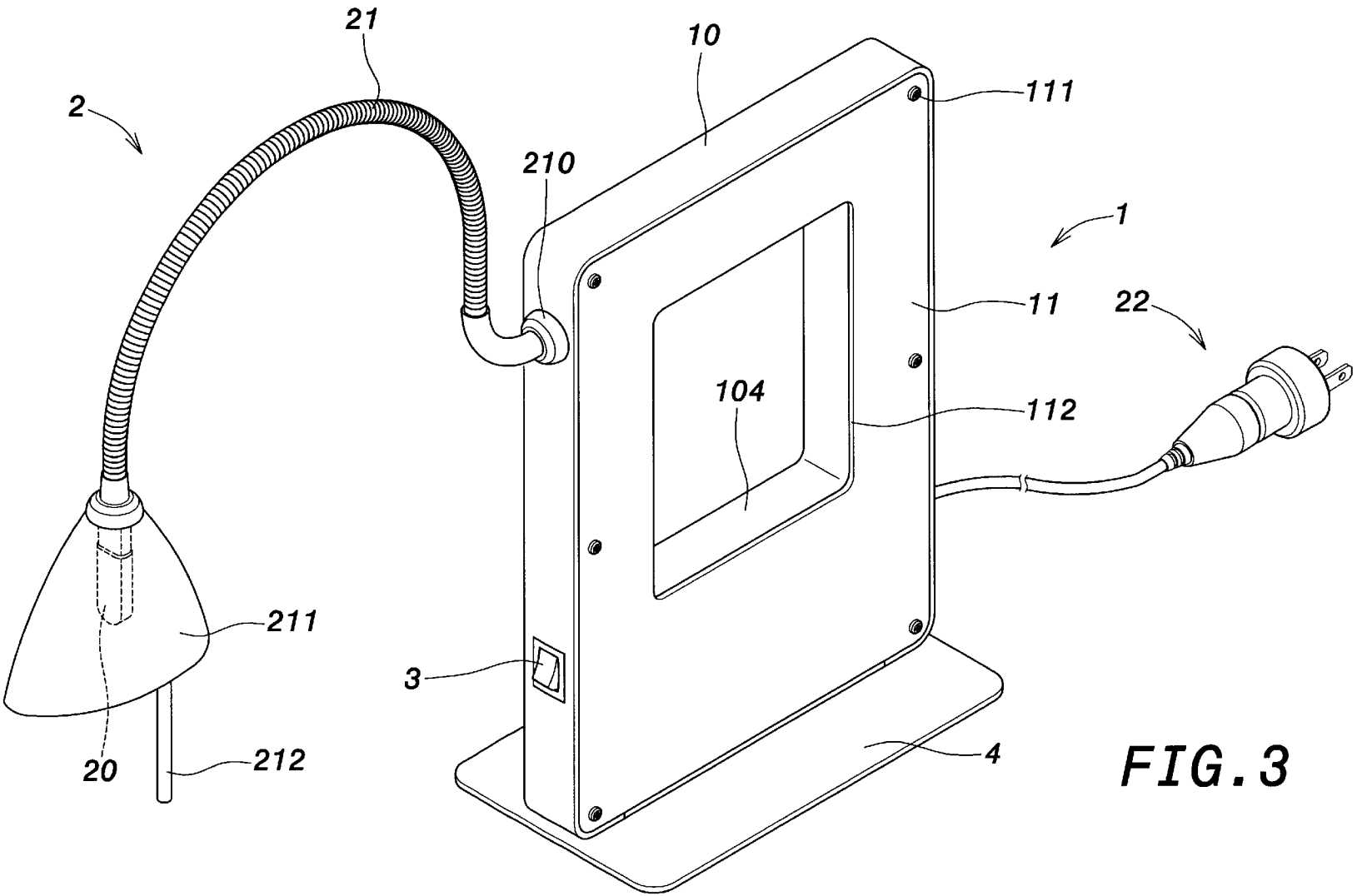
FIG. 3 is an assembled perspective view of the present invention.

Referring to FIGS. 2 and 3, the exploded perspective view and assembled perspective view of the present invention are illustrated. In the present invention a bookcase lamp is provided. The bookcase lamp includes a seat 1, a lamp 2, a switch 3. The seat 1 is a flat and long casing and is capable of being clamped between two books. The seat 1 is formed integrally or is formed by a box 10, a cover 11 and a base 4. The inner side of the periphery of the box 10 is installed with a locking portion 100. Two opposite covers 11 are formed with respective screw holes 110. Screws 111 serve to lock the box 10 to the cover 11. Moreover, the base 4 can be directly locked to the bottom of the seat 1, or a locking plate 40 is installed on the base 4 for locking the locking plate 40 to an interior of the box 10 so that the bookcase lamp can be steadily placed in the bookcase.

The lamp 2 serves to provide illumination and is mainly formed by a plurality of illuminators 20 and an electric plug 22 and is installed on the seat 1. The switch 3 serves to control the illumination of the illuminator 20. The switch 3 is installed on a positioning hole 103 of the seat 1. However, in order that the orientation of the illumination of the illuminator 20 can be adjusted in various angles, in the present invention, a lamp arm 21 is installed. The lamp arm 21 is a flexible tube with a predetermined length or a pipe like a snake abdomen, or is formed as a telescopic supporting tube (not show). Two ends thereof are installed with a lamp arm seat 210 and a lampshade 211. The lamp arm seat 210 is firmly secured to a retaining hole 101 of the seat 1, while the illuminator 20 is installed within the lampshade 211. Furthermore, since as the bookcase lamp is used, the heating temperature of the illuminator 20 is high and will cause the lampshade 211 to heat and become hot. Therefore, the lampshade 211 can not be adjusted the illuminating orientation of the illuminator 20 by hands directly. Therefore, an adjusting rod 212 manufactured by a low heat conductivity is installed on the lampshade 211. By holding the adjusting rod 212, the orientation of the illuminator 20 is adjusted.

Moreover, to save more material, a groove 201 and an opening 112 which are matched to one another are formed on the box 10 and cover 11 of the seat 1. The shape of the groove 104 and the opening 112 may be any geometrical shape. Consequently, not only the material is saved, but also the effect the bookcase lamp will not be effected. Furthermore, the shape of the bookcase lamp may be varied.

Figure 4:
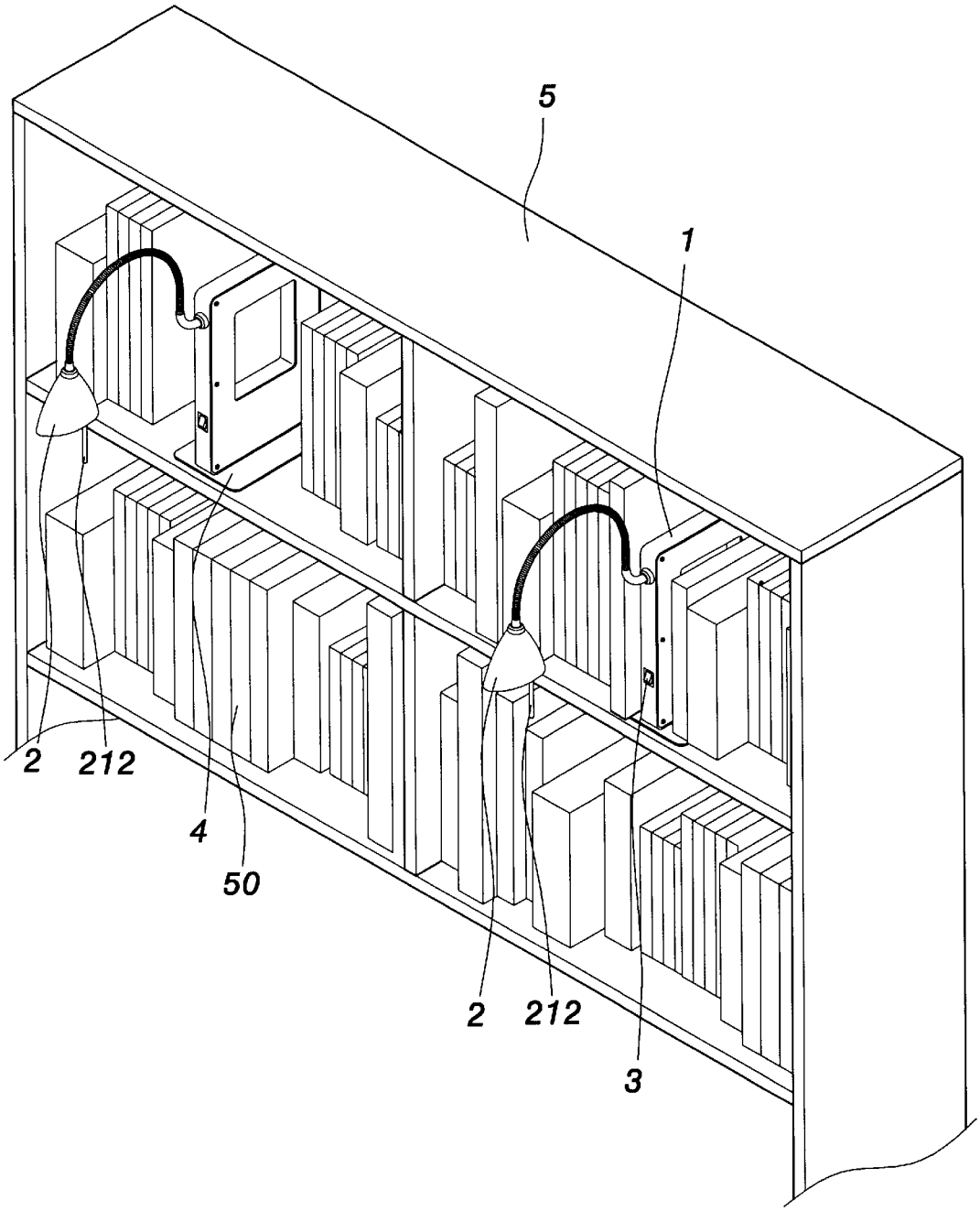
FIG. 4 shows an application of the present invention.

Referring to FIG. 4, the application of the present invention is illustrated. The seat 1 of the bookcase lamp is clamped between two books 50 in the bookcase lamp. Moreover, it can be placed in the bookcase 5 by the base 4. If the books in the bookcase 5, the switch 3 can be opened, and a lamp 2 is used to provide illumination. Furthermore, the book 50 can be searched at one time without spending much time. Therefore, it is convenient and thus the mood of the user will not be affected.

Figure 5:
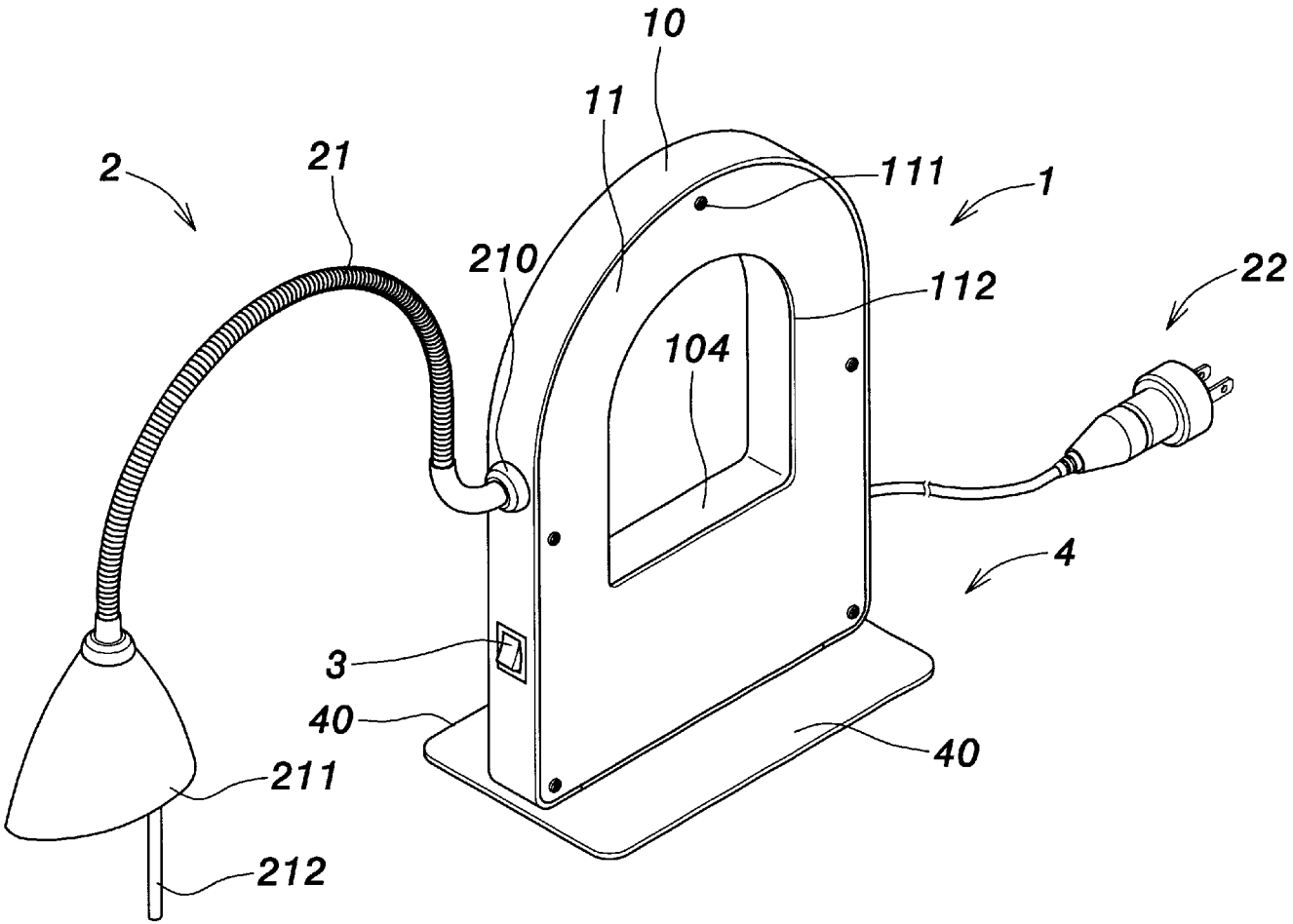
FIG. 5 is an assembled perspective view of another embodiment in the present invention.

With reference to FIG. 5, an assembled perspective view of another embodiment of the present invention is illustrated. The box 10 and the cover 11 of the seat 1 can be placed at the top so as to be formed with a round or any desired shape. Alternatively, under the case that the flat and long shape of the seat 1 is not changed, the outlook of the seat 1 can be changed for providing bookcase lamps of various shapes.

In summary, in the present invention, to search the book 50 in the bookcase lamp 5 conveniently, the bookcase lamp can provide illumination directly. The bookcase lamp can be placed in the bookcase lamp 5 as a book without occupying any space. It not only provides the illuminating effect in a library or a book room, but also it is convenient.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A bookcase illumination device comprising:

a main body member;

a supporting base plate mounted on and projecting from a lower surface of said main body member for receiving a book thereon, said book being positioned in contiguous relation to said main body member and said supporting base plate;

a flexible tubular member having a first end fixedly secured to said main body member;

an electric lamp mounted on a second end of said flexible tubular member; and, a thermally insulative adjustment rod projecting from said electric lamp, whereby a user may grasp and manipulate said thermally insulative adjustment rod to selectively angle and position said electric lamp.

2. The bookcase illumination device as recited in claim 1 wherein said main body member is adapted to be clamped between a pair of books.

3. The bookcase illumination device as recited in claim 1 wherein said main body member has a hollow passage formed therethrough.

4. The bookcase illumination device as recited in claim 1 wherein said supporting base plate has a locking plate projecting therefrom, said locking plate engaging said lower surface of said main body member.

5. The bookcase illumination device as recited in claim 1 wherein said electric lamp is in electrical communication with an electrical cord, said electrical cord being in communication with a power source.

* * * * *